US005706584A

United States Patent [19]

Bernardini

[11] Patent Number: 5,706,584

[45] Date of Patent: Jan. 13, 1998

[54] SINGLE-BLADE COOKING KNIFE

[75] Inventor: Leandro Bernardini, Calenzano, Italy

[73] Assignee: DBD SRL, Florence, Italy

[21] Appl. No.: 670,424

[22] Filed: Jun. 26, 1996

[51] Int. Cl.[6] ..... B26B 1/04

[52] U.S. Cl. ..... 30/289; 30/155; 30/294

[58] Field of Search ..... 30/151, 155–161, 30/289, 294, 330

[56] References Cited

U.S. PATENT DOCUMENTS

| | | | |
|---|---|---|---|
| 1,561,993 | 11/1925 | Nielsen | 30/161 X |
| 2,286,951 | 6/1942 | Brown . | |
| 2,810,194 | 10/1957 | Unsinger . | |
| 2,906,021 | 9/1959 | Cromoga | 30/155 X |
| 4,535,539 | 8/1985 | Friedman et al. | 30/159 X |

FOREIGN PATENT DOCUMENTS

WO-A8706102 10/1987 WIPO .

*Primary Examiner*—Douglas D. Watts

*Attorney, Agent, or Firm*—McAulay Fisher Nissen Goldberg & Kiel, LLP

[57] ABSTRACT

A single bladed cooking knife having two aligned cutting edges. An enclosure for the knife is provided in which an upper half-shell are joined and a lower half-shell joined to each other to form an enclosure for the knife; one end of the knife is coupled to the enclosure for pivoting the knife from a first position within the enclosure with one of the cutting edges positioned within the enclosure and another of the cutting edges being external of the enclosure to a second position with both of the cutting edges external of the enclosure. The knife blade is lockable, in the first and said second positions, and the knife blade is associated with a mechanism for unlocking the knife blade to move the knife blade from the first position to the second position and vice-versa.

20 Claims, 3 Drawing Sheets

SINGLE-BLADE COOKING KNIFE

BACKGROUND OF THE INVENTION

FIELD OF THE INVENTION

This invention is concerned with a single bladed cooking knife having two different cutting portions along a single cutting edge. More particularly, the invention is concerned with a manually movable single blade knife, pivotably articulated about a pin fixed within an oblong shell haft.

SUMMARY OF THE INVENTION

The knife, according to the invention comprises an oblong hollow shed haft or handle formed from plastic material and includes an upper half-shell and a lower half-shell joined together by means of a weld line. The blade is manually movable into and out of the shell haft through an elongated slot provided in the lower half shell and is articulated on a pin joint passing through a hole in the blade and held in the upper half shell. A front running end and a back running end are provided at opposite ends of the elongated slot between which the blade is movable. The blade is manually movable to an open condition into position onto the front running end with the blade completely exposed to provide for the two different cutting portions, one of which is a straight saw-toothed edged part and, the other is a half-moon or arcuate-shaped portion, in the form of a bending edge part; the blade cutting portions are brought into another position by manual movement to the back running end with the blade in a closed condition or a partial re-entry condition into the shell haft. In the closed condition of the knife, the saw-toothed edge portion is inside the shell haft, and the half-moon shaped potion with its inside bending edged part extends to the outer end of the blade to complete the blade with the half-moon cutting edge extending in the same cutting direction as the saw-toothed edged part, even though only the half-moon cutting edge is exposed. The blade is blocked or locked in position on the two oppositely disposed running ends by a constraint means including an iron leaf spring supported on one end between the half-shells at the back or rear running end and the offer end of the leaf spring or free end of the spring includes a hook for coupling with a lever for and guidance support of the other end of the leaf spring. The lever is movable on a joint mounted in the upper half shell, and movement or motion of the lever is started by a push-button which activates a U-shaped member or flat bed body which receives the hook at the free end of the leaf spring. The push button when pressed acts on the leaf spring to disconnect the hook from the flat bed body. A central small plate is provided as a modification and used instead of the push button.

When the blade knife is totally exposed, the blade has both the first part which is curved, exposed and the second part (also exposed) which has the saw-tooth configuration coupled with the first part at one end thereof, and at the other end the knife blade is pivoted on the pin joint. The straight saw-toothed edged part when it is exposed, is used in one way so that a user is able to slice farinaceous, fruits and vegetables, and in the blade's offer position with the blade partially placed into the haft and the saw-toothed portion is concealed, and only the first part or half-moon part is exposed. The blade part that is exposed, includes the half-moon shaped edged part which extends to the outer free end of the blade and the half-moon shaped part has an inside concave portion bent in such a way that it is particularly useful for peeling, scraping and for carrying away or removing parts from vegetables, fruits or other similar types of food. With this unique knife, which is particularly useful in connection with cooking, two different exposed edged parts are aligned along a single cutting edge of the knife can be alternatively brought to a use position for use in connection with different necessities.

A farinaceous material is a powdery substance, such as flour, meal of corn, consisting of or made of flour or meal starch, such as seeds, mealy in appearance.

To these ends, the invention consists in the provision of a single bladed cooking knife having two cutting edges, and provided with a housing or an enclosure for the knife including an upper half-shell and a lower half-shell joined to each other, one end of the knife is coupled to the enclosure for pivoting the knife from a first position within the enclosure with one of the cutting edges being positioned within the enclosure and another of the cutting edges being external of the enclosure to a second position with both of the cutting edges external of the enclosure. Locking means and releasing means are provided for locking the knife in the first and second positions and for releasing the locking means to move the knife from the first position to the second position and vice-versa.

The locking means includes a pair of projections proximate to one end of the knife and a projection receiving opening associated with lever means for receiving one of the pair of projections for locking the knife in either of its two positions.

The releasing means includes the lever means associated with the locking means for disengaging the lever means from one of the pair of projections to enable the knife blade to be moved from the first position to the second position and vice-versa. The lever means includes a lever pivotable about a joint coupled with the upper half shell, one end of the lever being associated with the locking means and the other end of the lever including means to move the lever to pivot the lever about the joint to move the one end for disengagement of the locking means. The locking means also comprises the pair of projections at one end of the knife and a projection receiving opening associated with the lever or for receiving one of the pair of projections for locking the knife in the first position and for receiving the other of the pair of projections for locking the knife in the second position. The locking means includes a leaf spring having one end coupled to the housing or enclosure at the rear running end and the other end is a free end including a hook, and the one end of the lever includes a flat bed body for receiving the hook or free end for movement of the other end of the spring. The spring also includes proximate to the other end a hole for receiving only one of the pair of diametrically oppositely disposed projections for locking the knife in one of the pair of positions, and the locking means includes a push button at the other end of the lever for pivoting the lever about the joint to move the one of the projections received in the hole for releasing the one of the projections for unlocking the knife from the spring for movement of the knife from the one position to the other position and vice-versa. The coupling means includes a pivot associated with the enclosure or housing, and the knife has one end provided with the projections articulated to the pivot for pivotal movement about the pivot from the one position to the second position. The projections are displaced from each other by an angle of 180° and an axis passing through the projections is orthogonal to a central axis of the pivot.

The two half-shells are joined by a weldment. The knife has an oblong shell which provides for an anatomy haft for raising a gripping condition. A key is provided having a central small plate for activation of the lever.

BRIEF DESCRIPTION OF THE DRAWINGS

In order that the invention may be more clearly understood, the same will now be described in connection with the accompanying drawings, in which.

DETAILED DESCRIPTION OF THE PREFERRED EMBODIMENTS

Figures 1, 2, 3:
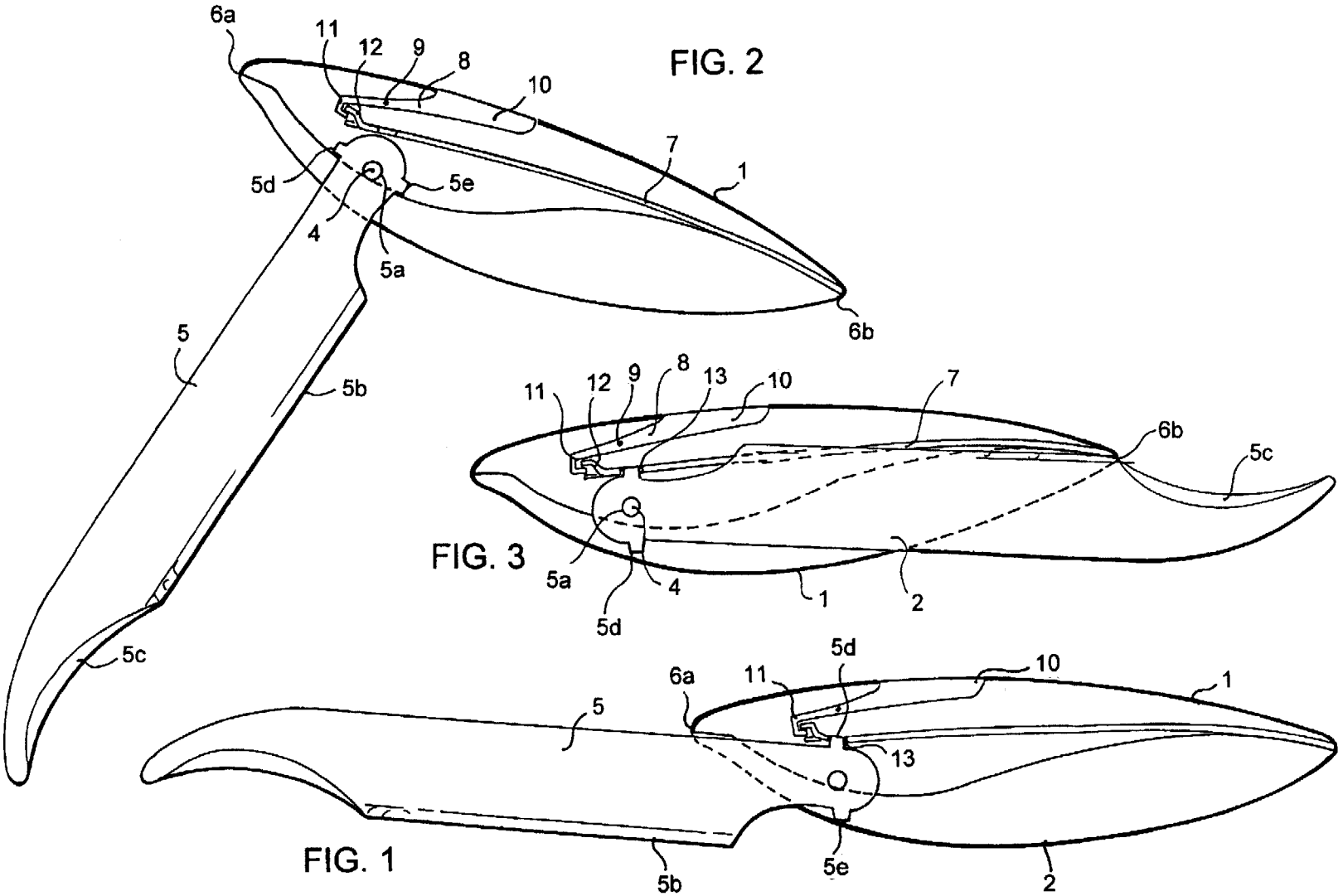
FIG. 1 is a schematic view of one embodiment of the knife with the blade set up on the front running end with the blade locked in one of its two locked and operating conditions, and illustrating a push-button operating mechanism.
FIG. 2 is a schematic view of the knife shown in FIG. 1, but with the blade disengaged from the front running end and positioned between the front running end and the rear running end to show the blade in a release condition.
FIG. 3 is a schematic view of the knife with the blade set against the back running end and showing the blade locked in the other of its two locked and operating conditions.
Figure 4:
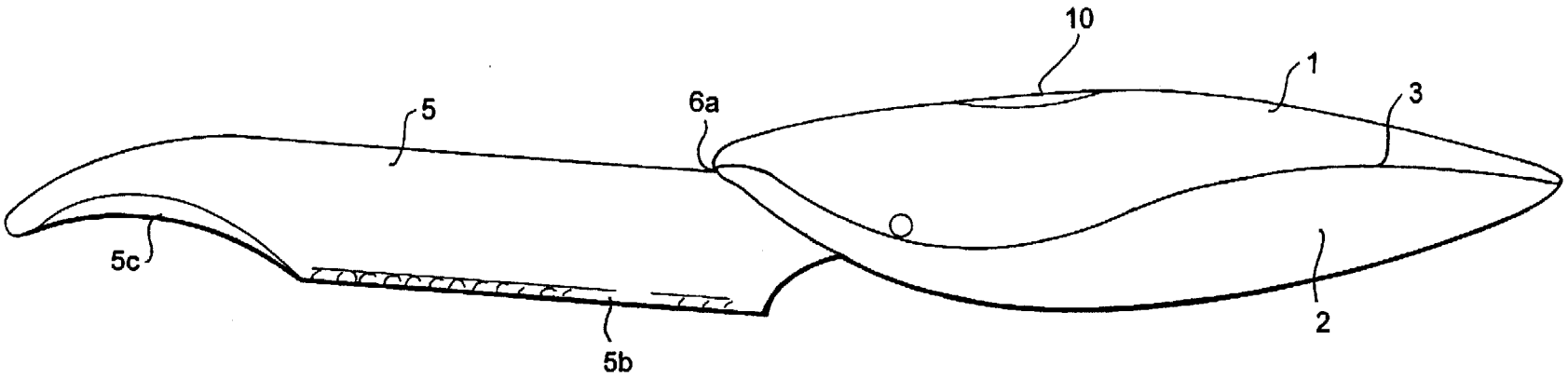
FIG. 4 is a schematic lateral view of the knife with the blade on the front running end and locked in this position to show the two cutting portions of the blade in detail.

Referring now more particularly to the accompanying drawings which show the best mode presently contemplated for carrying out the invention and in particular to FIGS. 1 to 5 and 7 which show one preferred embodiment, the knife is substantially oblong in shape and comprises a handle or haft including an upper hollow half shell 1 and a lower half shell 2 which are joined together along a weldment defined by a substantially S-shaped welding or joinder line 3 (FIG. 4) to form the oblong-shaped knife handle or haft.

A pin joint 4 is provided and held by upper half shell 1 for holding a rear end of knife blade 5 which is provided with an opening or hole 5*a* to receive pin joint 4 and to permit the rear end of knife blade 5 to pivot or rotate about pin joint 4.

The lower body or lower half shell 2 is provided with a longitudinal slot 6 which has a front running end 6*a* at the front of longitudinal slot 6 proximate to pin joint 4 and a rear running end 6*b* at the rear of longitudinal slot 6 remote from the pin joint 4 so that knife blade 5 which is articulated to pin 4 can be moved from one or a first position with one side, a non-cutting side of blade 5 in engagement with front running end 6*a* to another or second position with another side, a side containing two cutting portions of blade 5 in engagement with rear running end 6*b*.

Blade 5 which is articulated to pin or pin joint 4 is movable about pin joint 4 so that the bottom of the blade provided with rise 5*b* and having one cutting portion extending therefrom is exposed (FIG. 2) and moved out of lower half shell 2 and the top of the blade provided with the non-cutting side is engaged with front running end 6*a*.

A metallic leaf spring 7 generally formed from a material containing iron, where the two shells come together, has one end connected at the rear running end 6*b* to the two half shells and extends longitudinally in the upper half shell; the one end of metallic leaf spring 7 is supported and connected at the rear running end 6*b* between the joint formed between the upper half shell 1 and the lower half shell 2. A second end or operative end for spring 7 is provided with a hook 12 connected with and extending from the operative end is adapted to engage on an end of a lever 8, pivoted on a pivot or joint 9 to upper half shell 1 and provided with flat bed body 11, at a front end thereof and having its other end act as a push button 10 which is moved on or articulated to joint 9 for permitting lever 8 to move relative to the upper half shell 1, so as to release or engage hook 12.

Figure 5:
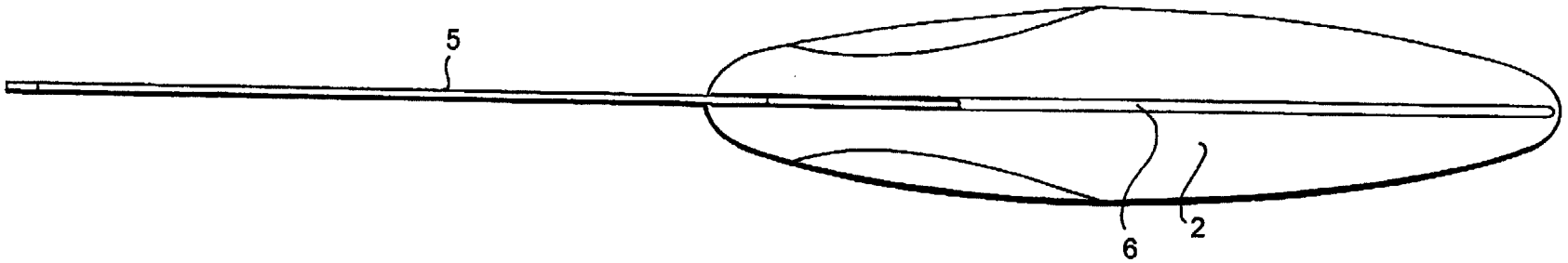
FIG. 5 is a schematic bottom view of the knife showing a slot in the lower haft into which the blade is movable for positioning thereof in its second locked and operating condition.

As best seen in FIG. 5, lower half shell 2 is provided with a slot into which blade 5 and rise 5*b* thereof (having one cutting portion) is movable for storage and out of which blade 5 and in particular rise 5*b* with one cutting portion is movable for use. Front running end 6*a* provides for a bearing surface against which the rear or non-cutting side of blade 5 is juxtaposed in its open condition and front running end 6*a* also provides for a bearing surface against which the non-cutting side or upper edge opposite to rise or lower edge 5*b* is juxtaposed with curved or bent edged part 5*c* is exposed. Rear running end 6*b* provides for a bearing surface against which the front of the blade provided with the cutting surfaces bears against rear running end 6*b* with rise 5*b* received within the lower shaft 2 and with curved or bent edged part 5*c* exposed. Portion 5*b* of blade 5 is a saw-toothed edged part.

Spring 7 is provided with a hole or alignment opening 13 configured to receive rise or projection 5*d* or 5*e* which rises or projections are aligned along an axis passing through them and disposed or positioned 180° from each other with the axis being orthogonal to a central axis of pin joint so as to lock blade 5 into two different positions spaced 180° from each other. Projection or rise 5*d* is receivable in alignment opening 13 to position the top of blade 5 against front running end 6*a* for locking blade 5 into its open and extended condition, and rise or projection 5*e* is receivable in alignment opening 13 to lock blade 5 in its closed, non-extended condition with the bottom portion and cutting portion 5*b* of blade received within lower haft 2 and the juncture between 5*b* and 5*c* bearing against bearing surface or rear running end 6*b* surrounding slot 6.

Lever 8 is pivotally joined or articulated about pivot 9 held in upper half shell 1 and includes flat bed body 11 at one end and push button 10 at the other end (see FIGS. 1 and 4) for movement of lever 8 about joint 9. Spring 7 has hook portion 12 extending from and connected with one end of spring 7 for engagement with flat bed body 11, and the other end of spring 7 is held fixed at rear running end 6*b* to the two half shells.

Figure 6:
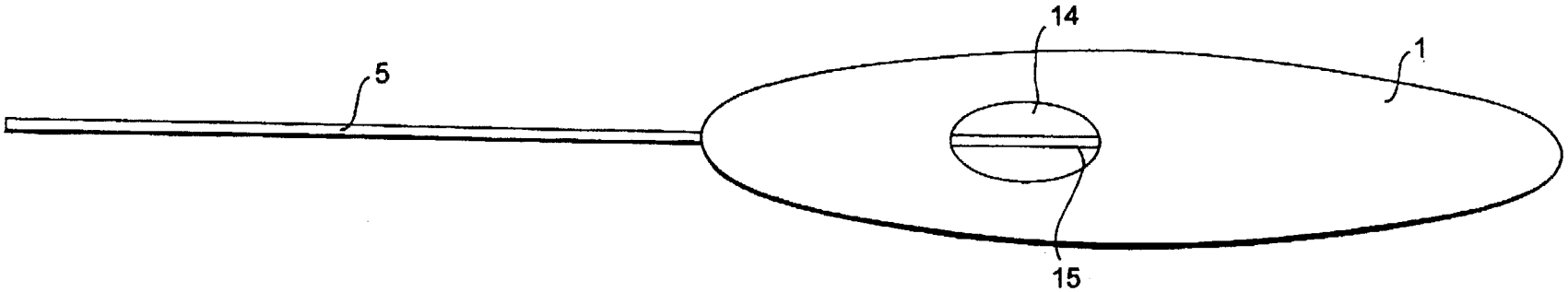
FIG. 6 is a top view of the knife showing a modification of the knife of FIG. 1, and provided with a key and central plate showing another operating mechanism.
Figure 7:
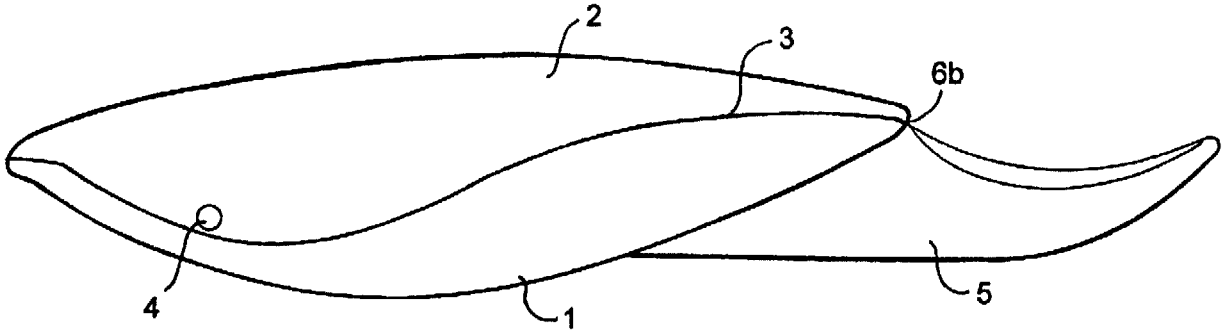
FIG. 7 is a lateral view of the knife of FIG. 1 or FIG. 6 with the blade set against the back running end and showing one cutting portion, the front cutting portion exposed and extending outside of the haft.

Reference is made to FIG. 6, which discloses another embodiment of the invention and shows blade 5 extending outside of haft 1, and an alternative means to push button 10 for activating operating lever 8, and for this purpose, haft 1 is provided with a key 14 and central small plate 15 for actuation of lever 8 in a manner similar to push button 10. In all other respects, this modification closely follows the previous embodiment except for the use of key 14 in lieu of push button 10.

Manual movement of the blade 5 is done to bring this blade into position on the front running end with both cutting edges of the blade totally exposed, to expose straight saw-toothed edged part 5b and, on the back running end with the blade in partial re-entry into the lower shell haft 2, only half-moon shaped part 5c with an inside bending edged part to complete the blade having the same cutting direction as the saw-toothed edged part is exposed.

Blade 5 is blocked in position on the front running end by fitting up of a constraint means comprising iron leaf spring 7 supported on the rear end thereof between the half-shells 1 and 2 and on the front end through hook 12 by lever 8 and moved or articulated on joint 9. Lever 8 is activated either by push-button 10 or key 14 through flatbed body 11 engaged with hook 12 of leaf spring 7 and is pressure engaged therewith. Raising of leaf spring 7 is determined and controlled by the action of the push button 10 or key 14, and leaf spring 7 is blocked until released to release either the rise or projection 5d or of rise or projection 5e from hole 13 in leaf spring 7. To move blade 5 from one running end to the other running end push-button 10 or key 14 is activated to raise leaf spring 7 to permit rise 5d or rise 5e to move out of hole 13. The knife, because of its oblong shell provides for an anatomy haft for raising the gripping condition.

While there is shown what is considered to be the presently preferred mode for carrying out the invention, it will be obvious to those skilled in the art that various changes and modifications may be made without departing from the scope of the invention.

What is claimed is:

1. A single bladed cooking knife comprising:

a single bladed cooking knife having two different cutting portions along a single cutting edge, one of said cutting portions being in the form of a saw-toothed edge part and another of said cutting portions being in the form of a half-moon shaped cutting part;

an enclosure for said knife including an upper half-shell and a lower half-shell joined to each other;

means coupling one end of said knife to said enclosure for pivoting said knife from a first position within said enclosure with said one of said cutting portions being positioned within said enclosure and the other of said cutting portions positioned external of said enclosure to a second position with both of said cutting portions external of said enclosure;

means for locking said knife in said first and said second positions; and means for releasing said locking means to move said knife from said first position to said second position and vice-versa.

2. The cooking knife as claimed in claim 1, including a welding joining the said two half-shells.

3. The cooking knife as claimed in claim 1, wherein said locking means comprises a pair of projections at one end of said knife and a projection receiving opening associated with said enclosure for receiving one of said pair of projections for locking said knife in said first position and for receiving the other of said pair of projections for locking said knife in said second position.

4. The knife as claimed in claim 1, wherein said coupling means includes a pivot associated with said enclosure, and said knife has one end articulated to said pivot for pivotal movement about said pivot from said one position to said second position.

5. The knife as claimed in claim 3, wherein said coupling means includes a pivot associated with said enclosure, and said knife having one end articulated to said pivot for pivotal movement about said pivot from said one position to said second position.

6. The knife as claimed in claim 5, wherein said projections are displaced from each other by an angle of 180° and an axis passing through said projections is orthogonal to a central axis of said pivot.

7. The cooking knife as claimed in claim 1, wherein said releasing means includes lever means associated with said locking means for disengaging said locking means to enable said knife blade to be moved from said first position to said second position and vice-versa.

8. A single bladed cooking knife having two cutting edges comprising:

an enclosure for said knife including an upper half-shell and a lower half-shell joined to each other;

means coupling one end of said knife to said enclosure for pivoting said knife from a first position within said enclosure with one of said cutting edges being positioned within said enclosure and another of said cutting edges positioned external of said enclosure to a second position with both of said cutting edges external of said enclosure;

means for locking said knife in said first and said second positions; and means for releasing said locking means to move said knife from said first position to said second position and vice-versa, said releasing means including a lever pivotable about a joint coupled with said upper half shell, one end of said lever being associated with said locking means and the other end of said lever including means to move said lever to pivot said lever about said joint to move said one end for disengagement of said locking means.

9. A cooking knife including a cutting blade having two edged parts with only a single cutting edge comprising:

a plastic oblong hollow shell haft formed by an upper half-shell and a lower half-shell joined with a weld line joining said upper half-shell and said lower half-shell;

a blade provided in said shell haft and articulated on a pin joint passing through a hole provided at one end of said blade, said blade being manually movable by hand for engagement with one of two spaced ends;

said two spaced ends including a front end and a rear end spaced from each other and formed at ends of a slot provided in said lower half-shell to provide for two positions for said blade;

said manual moving of said blade to bring it into said positions, on said front end with said cutting edge totally exposing a straight saw-toothed edged part and, a half-moon shaped cutting part forming said two-edged parts and, on said back end with said cutting edge of the blade in a partial re-entry into said shell haft, only said half-moon cutting part shaped being exposed and having an inside edged part to complete the blade having said half-moon shaped part forming the saw-toothed edged part which is contained within said shell haft;

means for locking the blade in a position on each of the spaced ends by fitting up of a constraint means including an iron leaf spring supported on one end between the half-shells and on the other end by a hook and lever arrangement, said lever being movable on a joint and associated with a push-button and said lever and hook being activated in response to said push button;

engagement means on said leaf spring for engaging at least one rise, and removable therefrom in response to said push button for enabling said knife blade to be manually movable relative to said oblong shell; and said blade being manually movable from one end to the other end in response to activation of said push button for raising the leaf spring to permit one of said rises to be disengaged from the engagement means.

10. The cooking knife as claimed in claim 8, wherein said lever means includes a lever pivotable about a joint coupled with said upper half shell, one end of said lever being associated with said locking means and the other end of said lever including means to move said lever to pivot said lever about said joint to move said one end for disengagement of said locking means.

11. The cooking knife as claimed in claim 9, wherein said cutting blade having two edged parts includes a first cutting portion in the form of a saw-toothed edged part and a second cutting portion in the form of a half moon shaped cutting part.

12. The cooking knife as claimed in claim 8, wherein said locking means comprises a pair of projections at one end of said knife and a projection receiving opening associated with said enclosure for receiving one of said pair of projections for locking said knife in said first position and for receiving the other of said pair of projections for locking said knife in said second position.

13. The knife as claimed in claim 8, wherein said locking means includes a leaf spring having one end coupled to said enclosure at said rear running end and said other end including a hook, and said one end of said lever including a flat bed body for receiving said hook for movement of said other end of said spring.

14. The cooking knife as claimed in claim 13, wherein said locking means comprises a pair of projections at one end of said knife and a projection receiving opening associated with said enclosure for receiving one of said pair of projections for locking said knife in said first position and for receiving the other of said pair of projections for locking said knife in said second position.

15. The knife as claimed in claim 14, wherein said spring includes proximate to said other end a hole for receiving one of said pair of projections for locking said knife in one of said pair of positions, and locking means including a push button at said other end of said lever for pivoting said lever about said point to move said one of said projections received in said hole for releasing said one of said projections for unlocking said knife from said spring for movement of said knife from said one position to said other position and vice-versa.

16. The knife as claimed in claim 15, wherein said coupling means includes a pivot associated with said enclosure, and said knife having one end articulated to said pivot for pivotal movement about said pivot from said one position to said second position.

17. The knife as claimed in claim 16, wherein said projections are displaced from each other by an angle of 180° and an axis passing through said projections is orthogonal to a central axis of said pivot.

18. The cooking knife as claimed in claim 9, wherein said two half-shells are joined by a weldment.

19. The cooking knife as claimed in claim 9, wherein said oblong shell provides for an anatomy haft for raising a gripping condition.

20. The knife as claimed in claim 9, including a key having a central small plate for activation of said lever.

* * * * *